United States Patent [19]

Granström

[11] Patent Number: 5,032,963

[45] Date of Patent: Jul. 16, 1991

[54] LENS FOR TRAFFIC LIGHTS AND METHOD OF MAKING SAME

[75] Inventor: Ernst Granström, Köping, Sweden

[73] Assignee: EB Traffic Systems Aktiebolag, Stockholm, Sweden

[21] Appl. No.: 487,606

[22] Filed: Mar. 2, 1990

[30] Foreign Application Priority Data

Mar. 29, 1989 [SE] Sweden ..... 8901096

[51] Int. Cl.[5] ..... F21V 5/00

[52] U.S. Cl. ..... 362/337; 362/209; 362/340; 350/431

[58] Field of Search ..... 362/335, 329, 337, 340, 362/309, 338; 350/104, 106, 167, 431; D26/122, 123

[56] References Cited

U.S. PATENT DOCUMENTS

| | | | |
|---|---|---|---|
| 1,385,570 | 7/1921 | Miller et al. | 362/335 |
| 2,286,201 | 6/1942 | Farrand et al. | 362/335 X |
| 4,785,385 | 11/1988 | Holst | 362/337 X |

*Primary Examiner*—Stephen F. Husar

*Attorney, Agent, or Firm*—Nilles & Nilles

[57] ABSTRACT

A light diffusing lens and a method of making such a lens for use in traffic lights etc. and of the known type in which a nearly parallel light beam in projected on a lens adapted to scatter the light within certain predetermined limits, and in which the lens comprises a large number of cavities arranged on the inner surface of the lens, which cavities act as elementary lenses (2) arranged in parallel rows (3) extending in the horizontal direction, and in which each elementary lens (2) comprises at least two integral concave lens parts, namely a lower lens part (5) having the shape of a part of a half-ball, and an upper lens part (6) which is directly integral with said lower lens part (5) and which is stepwise or successively widened to the shape of a bell and which is ended by an upper, straight cross cut lens surface (4). The light diffusing lens is made by spark machining of two co-operating graphite electrodes having strips of graphite material, in which strips cavities corresponding to the elementary lenses (2) are milled by means of a ball cutter.

10 Claims, 4 Drawing Sheets

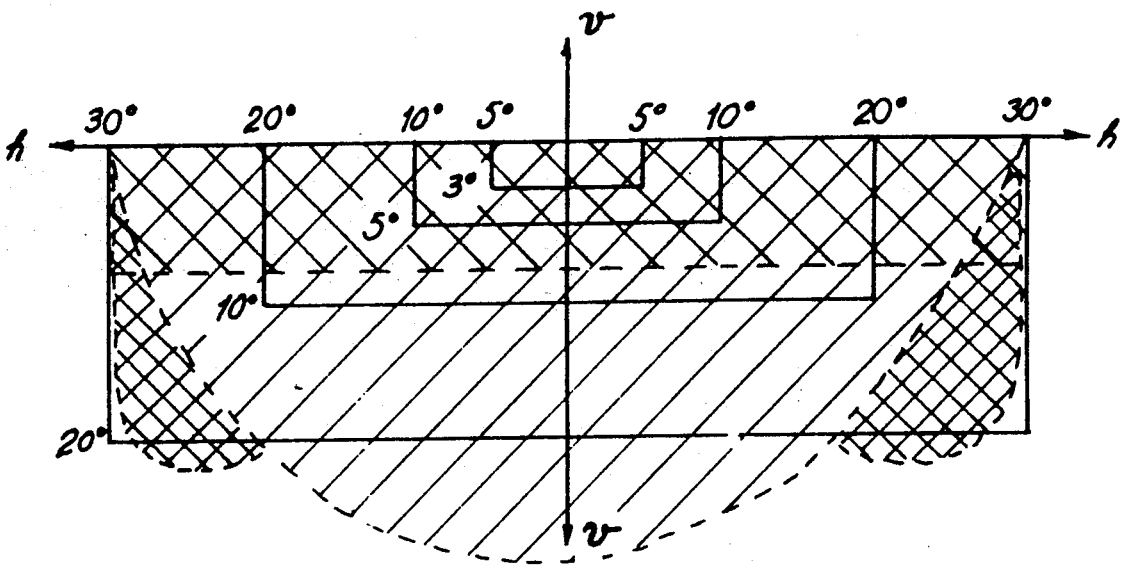
FIG. 1
FIG. 2
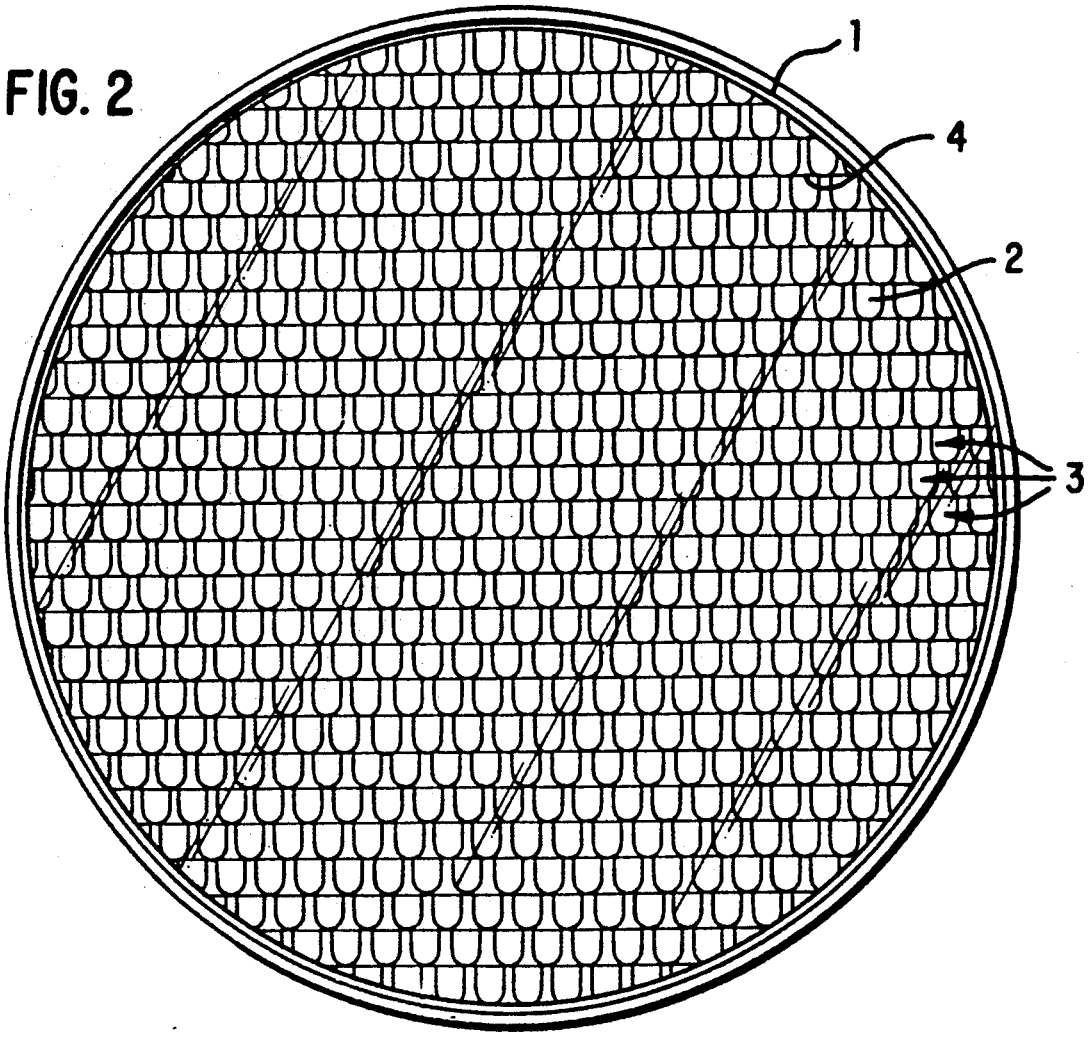

LENS FOR TRAFFIC LIGHTS AND METHOD OF MAKING SAME

BACKGROUND OF THE INVENTION

The present invention relates to a light diffusing lens intended to be used in traffic lights of the known type, in which a generally point formed light source via a mirror, preferably a parabolic mirror, projects a nearly parallel light beam onto an un-coloured or coloured (red, yellow, green) lens adapted to scatter the light within certain predetermined limits.

Normally it is desired to scatter at least the main part of the light passing the lens over an angle downwards from the horizontal plane of about 20° and over an angle aside of the vertical optical axis of about 30° in other directions. On the contrary it is not desired to have the light scatter in the direction upwards.

FIG. 1 diagrammatically illustrates the international standard adopted by "CIE 1980" and which shows the desired light scattering of traffic lights. It is evident that it is desired to have a main light scattering within a substantially rectangular area restricted for instance by an angle of between +/−30° from a vertical axis v-v and by an angle extending from the horizontal plane h-h and 20° downwards.

Many different types of optical lenses are used for traffic lights, for instance the lenses shown in the two U.S. Pat. Nos. 2,907,249 and 3,807,834. Both said types of lenses are, at the inner surface thereof formed with light refracting elements in the form of bulges of different shape and size directed inwardly towards the light source and intended to give the desired light refraction. It may be difficult and expensive to manufacture such lenses, and normally said lenses give other light refractions than the desired light refraction according to the above mentioned adopted standards. In particular many known lenses give a poor light refraction to the two lower-outer corners at the angle 30/20 (or 20/10, 105 etc.). Other known lenses may give a too strong or a too poor light refraction either to the sides or downwards, or they may give a non-desired light refraction in the direction upwards.

Therefore, the basis of the invention is to solve the problem of providing a light diffusing lens which gives an optimum light refraction, especially a light refraction which covers an optimumly large part of above mentioned substantially rectangular light refraction area, which lens may easily be adapted for giving other types of light refraction, and which lens also can be manufactured very simply.

SUMMARY OF THE INVENTION

A light diffusing lens according to the invention is composed by a large number of elementary lenses which may be of the same or different size but which all have the same basic shape and comprising a cavity in the inner surface of the lens body that has at least two consecutive lens surface parts. More specifically, each elementary lens comprises a first lens surface part in the form of a half of a rotational symmetrical concave surface, for instance a hemisphere-shaped surface, and a second lens surface part, which widens outward from the said first lens surface part continuously or by steps atorically and in a bell shape upwards to a planar cross-cut end surface, and which is symmetrical about a vertical plane which is parallel to the light beam. Further this lens part surface is formed such that cross sections which are orthogonal to an inwardly bowed line extending in said vertical plane and having its starting point at the centre of curvature for the first lens part, have uniform intersectional lines, for instance circular intersectional lines. In addition to the said hemisphere-shaped lens surface part and the said second atorically widened bell-shaped lens surface part the lens may be formed with a third cylindrical lens surface part having vertical generatrices such that the intersectional lines for the horizontal cross sections are uniform with the intersectional lines of the said second lens surface part. This third lens surface part may be located between the two first mentioned lens surface parts, at the upper part above the second lens surface part, or it may be split into several parts interleaved by portions of the second lens surface part.

BRIEF DESCRIPTION OF THE DRAWINGS

Further characteristics and advantages of the invention will be evident from the following detailed description in which reference will be made to the accompanying drawings. In the drawings FIG. 1 is, as previously mentioned, a diagrammatical illustration f the light refraction pictures of a lens for traffic lights as preferred according to established standards.

FIG. 2 is a front view of a traffic light lens according to the invention.

DESCRIPTION OF THE PREFERRED EMBODIMENTS

As mentioned, FIG. 1 is a diagrammatical illustration of the desired light picture from a lens for a traffic signal light or a similar means, in which the light from a light filament of a bulb meets the lens with substantially parallel light rays, generally reflected by a parabolic mirror. It is evident that the light ought to be refracted or scattered over a substantially rectangular surface, for instance the surface between +/−30° in the horizontal direction h-h and between the horizontal plane 20° below the horizontal plane in the vertical direction v-v.

Most preferably it is desired to obtain an extra strong light within an area from the horizontal plane and a slight distance downwards, for instance to an angle of 8°-10° (marked with large space cross hatching in FIG.

1), and it is also desired that the light fills up an optimum large part of the indicated rectangular surface as evenly as possible.

To this end the lens of FIG. 2 is invented, which lens is cup-shaped lens body having a slightly convex front surface, an inner surface and a rim 1 by means of which the lens can be mounted in the signal light body as known per se. The lens is composed of a large number of elementary lenses 2, which are arranged in horizontal rows 3, in which rows the elementary lenses 2 are located close to each other both in the horizontal direction and in the vertical direction so that the lens surface is substantially filled up with elementary lenses. The number of elementary lenses can be varied as desired. A lens having a large number of elementary lenses presents a more even light picture than a lens having a small number of elementary lenses, and also the depth of each elementary lens becomes less in a lens having a large number of elementary lenses than in a lens having a small number of elementary lenses, and hence it is possible to use a thinner lens material that if the lens has a small number of elementary lenses. As known the front surface of the light diffusing lens is slightly convex for eliminating the appearance of reflections etc.

Figure 3:
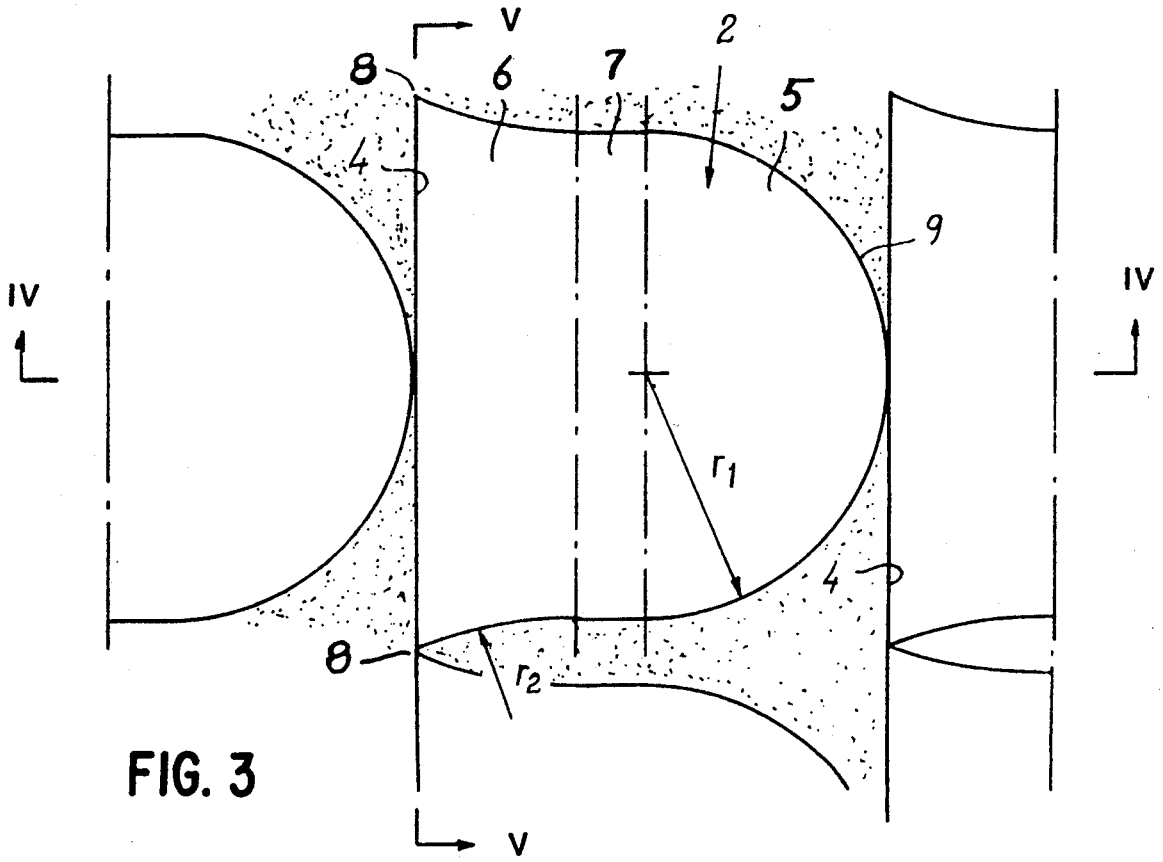
FIG. 3 shows more in detail the shape of an elementary lens of the traffic light lens shown in FIG. 2.
Figure 4:
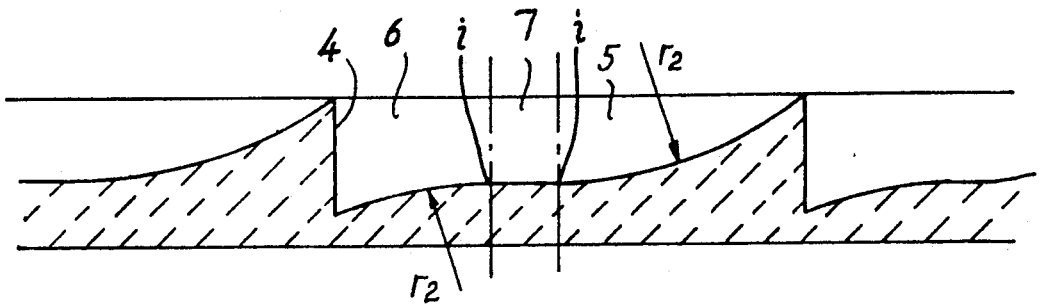
FIG. 4 is a cross section along line IV—IV of FIG. 3.
Figure 5:
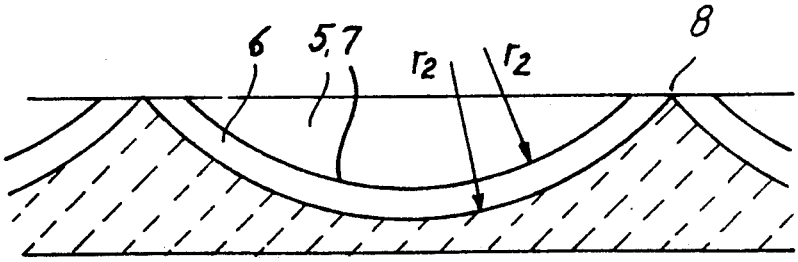
FIG. 5 is a cross section along line V—V of FIG. 3.

As most clearly shown in FIGS. 3–5 each elementary lens is formed as a lens cavity having an outer limiting surface which is similar in shape to an upside-down bell, and which has a planar cross cut upper limiting edge or end surface 4 extending in the horizontal plane h-h. Each elementary lens cavity is composed of at least two, and in the illustrated case three, different lens surface parts, namely a lower lens part 5 in the form of a cup having the shape of a segment of a hemisphere, and an upper atoric lens part 6 having a stepped or continuous inflection point that provides a widened cavity which in a cross section taken perpendicularly t the lens surface provides an elliptical intersectional line, the short or vertical axis of which is orthogonal to the light beam and the long or horizontal axis of which becomes successively longer or wider to provide a bell-shaped periphery as shown in FIG. 3 and ends in the planar end surface 4. Between the lower hemispherical lens part 5 and the upper, bell-shaped lens part 6 there may be a, limiting interface surface having an intermediate plain, cylindrical lens part 7 of varying length. The limiting surface includes one or more inflection points i as will be more fully explained hereinafter.

It is also possible to form the lower lens part as an ellipse or a similar shape, so that said part has a width in the horizontal direction which is greater than the width shown in FIGS. 3 and 5.

The lower, substantially hemisphere-shaped lens surface part 5 has a first width that makes the light spread or scatter in the horizontal direction and in an angle downwardly as shown with the slant line markings (///) of FIG. 1. Said lower lens part provides the main light refraction of the lens. The part of the light extending below the lien 20° which is refracted more than is normally needed, is not absolutely necessary but may be of value for instance in case the traffic light signal is mounted high up in the air like in street crossings etc. In such cases it may otherwise be difficult to observe the light. In case said last mentioned portion of the lens part 5 is not wanted it may be cut off like a chord and can be ended by a cross cut (not illustrated) end surface.

The intermediate, cylindrical lens part 7 diffuses or scatters the light mainly only in the horizontal direction as marked with large space cross hatching in FIG. 1, so that the mainly horizontally directed light is amplified and has a better visability also from long distance.

The upper, lens part 6 has a bell-shaped peripheral portion of a second width wider than the first width of the lower part 5 and provides a diffusion of the light of the sides as shown by the small space cross hatching in FIG. 1, whereby the light becomes diffused especially to the horizontally spaced lower corners between the horizontal and vertical lines, which corner areas will otherwise get only a faint light.

It is obvious that the elementary lenses 2 are arranged so close to each other that the edge points 8 of the bell-shaped upper lens parts 6 of adjacent elementary lenses touch each other, and so that a bow-shaped bottom point 9 of the lower, hemispherical lens 5 part touches the end surface 4 of the adjacent lower elementary lens.

Figure 6:
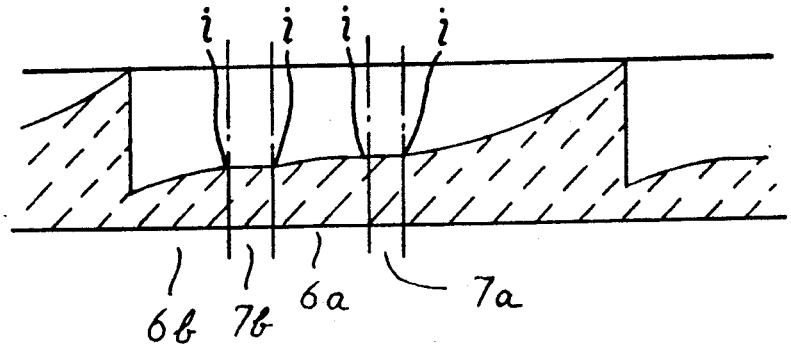
FIG. 6 shows, in a view similar to that of FIG. 4, an alternative longitudinal cross section profile of an elementary lens.

It is possible, for instance for increasing the number of the shining points of the lens in the horizontal direction, to split the cylindrical elementary lens part 7, for instance as shown in FIG. 6, so that the elementary lens has two cylindrical parts 7*a* and 7*b*. In this embodiment each elementary lens 2 will have two widened spaced apart bell-shaped upper parts 6*a* and 6*b*.

Figure 7:
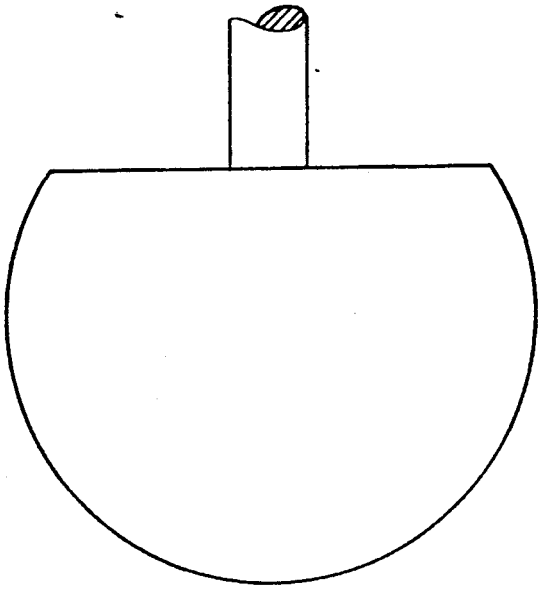
FIG. 7 shows a ball cutter in the form of a regular ball, by means of which the elementary lens shown in FIGS, 3, 4 and 5 can be made.

As will now be explained more closely each elementary lens cavity can be formed by means of a ball cutter or a profile cutter. FIG. 7 shows a cutter formed as a regular ball. An elementary lens of the type shown in FIGS. 3–5 can be made by means of said cutter.

Figure 8:
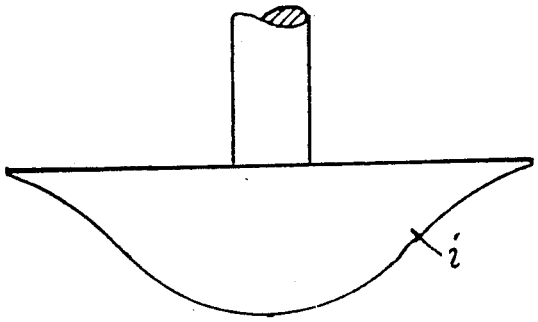
FIGS. 8 and 9 similarly show a couple of alternative ball or profile cutters for making alternatively formed elementary lens cavities.
Figure 9:
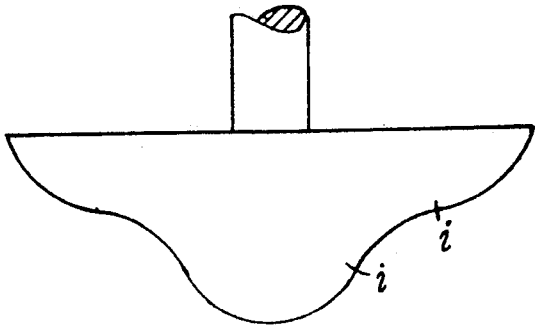

FIG. 8 shows a rotational-symmetrical profile cutter which is formed with one inflection point "i", and FIG. 9 shows a further modified profile cutter which in this illustrated case is formed with two inflection points "i".

By arranging one or more inflection points in the elementary lens cavity, as mentioned above, there is obtained an increased number of shining points when looking at the lens from different viewing angles. In some cases the number of shining points, however, ought to be limited since otherwise the points may seem to become baked together thereby impairing the possibility of observing the traffic sign.

Figure 10:
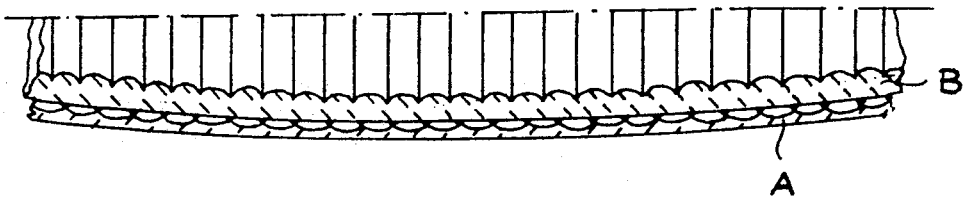
FIG. 10 framentary shows a cross section through an alternative form of a lens according to the invention.

FIG. 10 diagrammatically shows a cross section through a development of the previously described lens, and in this case the lens is composed of a first lens A of the above described type and at the inner side thereof and in contact with or in close proximity of said first lens an auxiliary lens B, the front side of which is smooth and the rear side of which has vertical flutes which are bow shaped in a transverse cross section view and which improve the refraction or diffusion in the horizontal direction (sideways) of the light which is reflected by the mirror. The front surface of said auxiliary lens is in contact with the raised portions at the rear side of the first lens A. As previously mentioned the lens A may be coloured, or it may be uncoloured clear glass. The auxiliary lens should only be clear glass.

When forming the lens with text or symbols like pedestrians, cyclists etc. such text or symbols preferably are applied to the smooth front surface of the auxiliary lens. Thereby the text of picture symbols become protected against wear and damage.

Alternatively to forming the auxiliary lens with the said flutes it may be formed opalized.

Figure 11:
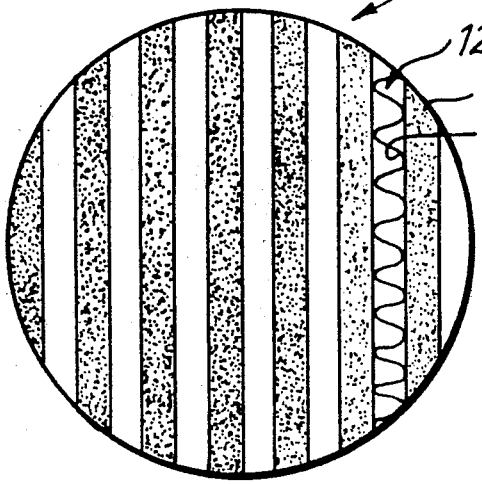
FIGS. 11 and 11*a* diagrammatically shows a stage of the manufacture of a tool for making the lens according to the invention, and FIG. 12 diagramatically and in a vertical cross section shows a ready tool for press moulding of a lens according to the invention.
Figure 12:
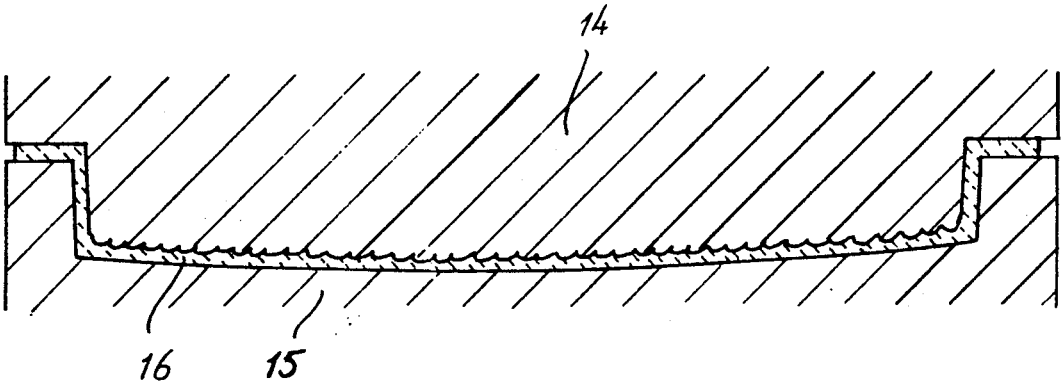

A lens of the above described type is made as follows, as diagrammatically illustrated in FIGS. 11, 11*a* and 12:

Referring to FIG. 11, parallel grooves 11*a* are milled in a first plate of an electrode material, for instance a graphite plate 10*a*, whereby the width and the mutual distances between said grooves correspond to the intended width of each row 3 of elementary lenses 2. Between said grooves 11*a* there are consequently left strips 12*a* of graphite in which strips of graphite cavities 13*a* are milled by means of a ball cutter or a profile cutter giving the cavities a shape, size and location which exactly corresponds to those of the elementary lenses to be formed. To accomplish this milling the ball (or profile) cutter is moved from right to left as shown in FIGS. 3–6 at the same time as the cutter is lowered according to a predetermined program so that the cavities get exactly the shape which is shown in FIGS. 3–6. The ball cutter leaves the graphite strip 12*a* at a groove 11*a* which thereby provides the plain cross cut end surface 4 of the ready lens.

Normally the profile cutter is moved only straight downwards in the lens plate material thereby forming the lower lens part 5, and thereafter the cutter is moved sideways and/or downwards and sideways corresponding to the vertical direction of the ready and mounted lens. It is, however, also possible to move the ball or profile cutter, during or after each step, in a direction at a right angle to the formal direction of displacement, that is in a direction corresponding to the horizontal direction of a ready and mounted traffic lens. Thereby the width of the elementary lens is increased. Alternatively the same effect can be obtained by using a profile cutter having the desired width/depth relationship, for instance a profile cutter having an elliptical or other cross section shape, or a profile cutter having a flattened bottom surface.

Figure 11A:
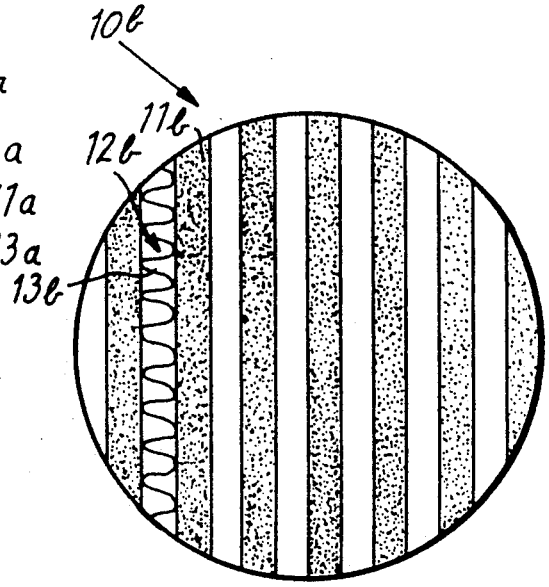

Similarly, referring to FIG. 11*a*, grooves 11*b* are milled in a second graphite plate 10*b* but in the case in the locations corresponding to the graphite strips 12*a* of the first graphite plate 10*a*, and likewise cavities 13*b* are milled in the graphite strips 12*b* by means of a ball cutter. The two graphite plates 10*a* and 10*b* provide, in common, a so called spark electrode for machining a matrix blank of steel. The matrix blank is machined by electrical discharge machining hereinafter termed "spark machining" , as conventional, in two steps by means of the graphite plates 10*a* and 10*b*, whereby any material aside of the cavities corresponding to the elementary lenses 2 is sparked off so that a matrix 14 is obtained which is formed with raised portions corresponding to the cavities 13*a* and 13*b* of the graphite plates 10*a* and 10*b*.

The matrix 14 is thereafter used, as known per se, in common with a matching matrix 15 for press moulding a material 16 to a lens according to the invention.

Any material can be used for the lens body which is clear and transparent. Preferably the material should have: a good strength; it should be as durable as possible; it should be easy to mould and to impart with the predetermined colours; it should be light resistant in the sense that the colours, for instance green, yellow and red, do not change by time; and the material should be UV-stabilized etc. To this end there is preferably used plastic materials, in particular some acrylic plastic material, or still more preferably a polycarbonate plastic material.

In a practical embodiment of the invention the lens was formed with elementary lenses 2 provided by a ball cutter having a diameter of 11 mm, whereby said ball cutter, for providing the lower, ball-formed lens part 5 was lowered 1.2 mm into the graphite material thereby giving said lens part a radius of 3.3 mm; the intermediate lens part 7 was prepared by displacing the ball cutter a distance of 1.0 mm without lowering same; and finally the ball cutter was displaced a distance of 2.3 mm while lowering the cutter 0.45 mm thereby providing the bell-shaped cavity part. The width of the cross cut end surface 4 was about 7.7 mm and the depth at said end surface was 1.65 mm. Thus, the width of each row 3 of elementary lenses 2 was 6.6 mm and the elementary lenses of each row of lenses were located 7.7 mm from each other.

What is claimed:

1. A light diffusing lens for use in traffic lights or the like wherein a light source projects a nearly parallel beam of light via a mirror onto a lens which scatters said light within predetermined limits comprising:

a lens body having an inner surface, a front surface and horizontally spaced lower corner areas;

a large number of cavities in said lens body arranged in substantially parallel vertically spaced horizontal rows to provide a plurality of elementary lenses all of which have the same basic shape of the same or different size;

each of said elementary lenses including at least lower and upper directly integral concave lens surface parts joined at a limiting surface, said lower lens surface part being in the shape of a symmetrically shaped segment of a rotated body and having a first horizontal width at said limiting surface, and said upper lens part surface having a second horizontal width that is wider than said first width and having a bell-shape periphery which terminates in a planar crosscut end surface for diffusing said light to said lower horizontally spaced corner areas.

2. A light diffusing lens according to claim 1 wherein said limiting surface has one or more inflection points.

3. Lens according to claim 1 wherein said lower lens surface parts each have a bow-shaped lower edge and said upper lens parts each have spaced apart edge points at said planar end surface, and wherein said end point of upper lens surface parts of adjacent elementary lenses tough each other, and said lower, bow-shaped edge of each lower lens surface part touches the crosscut edges of the elementary lens that is immediately therebelow.

4. Lens according to claim 1 wherein each elementary lens has an intermediate lens surface part located between said lower lens surface part and said upper bell-shaped lens surface part, said intermediate lens surface part having the shape of a straight cylindrical envelope.

5. A method of making alight diffusing lens according to claim 1 having a large number of elementary lenses formed by cavities therein comprising the steps of:

A. forming a plate out of an electrode material;

B. forming a milled electrode by milling cavities on said plate having a shape, size and location corresponding to said cavities that will form the elementary lenses in the lens that is to be made;

C. forming a steel plate to be used as a matrix;

D. electric discharge machining said steel plate by using said milled electrode as an electrode to remove metal from selected areas thereof and leave raised portions corresponding in shape, size and location to said cavities in said milled electrode to form a first mold part for said inner surface of said lens;

F. forming a second mold part for said front surface of said lens;

G. placing a moldable lens material between said first and second mold parts; and H. press molding said lens material into said lens.

6. The method according to claim 5 wherein:

in step A, first and second plates are formed from a graphite material; and in step B, forming said first graphite plate by milling vertically spaced horizontal grooves therein having a width and length corresponding to said horizontal rows of elementary lenses in the lens that is to be made while leaving horizontal strips of graphite material corresponding to every second row of elementary lenses, milling cavities out of said strips of said first graphite plate corresponding to the shape, size and location of the elementary lenses in those rows of the lens that is ultimately to be formed that correspond to said strips, forming a second graphite plate by milling vertically spaced grooves having a width and length corresponding to said horizontal strips left in said first plate, milling cavities out of said strips of said second graphite plate corresponding to the shape, size and location of the elementary lenses in those rows of the lens that is ultimately to be formed that correspond to said strips, and combining said first and second graphite plates to form said milled electrode.

7. The method according to claim 5 wherein in step B, said milling is by means of a ball cutter.

8. The method according to claim 5 wherein in step B, said milling is by means of a rotatable profile cutter having a cross section shape provided with one or more inflection points.

9. The method according to claim 5 wherein said milled electrode has longitudinal and transverse directions and in step B said milling is accomplished by using a rotatable cutter which is given:

a first movement straight downward into said milled electrode to form a cavity in said milled electrode corresponding to said lower lens surface part, and if a wider lower lens surface part is required, thereafter moved transversely in one or both directions to increase the width of said cavity and forms said wider lower lens surface part, and thereafter a second movement longitudinally and then transversely of said milled electrode to form a cavity corresponding to said supper bell-shaped lens surface part.

10. The method according to claim 9 wherein in said second movement, said cutter initially is only moved longitudinally to form a cavity corresponding to an intermediate cylindrical lens surface part located between said lower and upper lens surface parts and after said initial movement of said cutter is moved both longitudinally and transversely to form a cavity corresponding to said wider upper lens surface part.

* * * * *